US005195256A

United States Patent [19]

Kim

[11] Patent Number: 5,195,256

[45] Date of Patent: Mar. 23, 1993

[54] SHOCK ABSORBING DEVICE FOR USE IN A MIDSOLE OF A FOOTWEAR

[76] Inventor: Sang D. Kim, Woosung Apt. 104-904, 14-3 Kayang-Dong, Kangso-Gu, Seoul, Rep. of Korea

[21] Appl. No.: 885,833

[22] Filed: May 20, 1992

[30] Foreign Application Priority Data

Jan. 31, 1992 [KR] Rep. of Korea ..... 92-1455

[51] Int. Cl.[5] ..... A43B 13/18; A43B 21/26

[52] U.S. Cl. ..... 36/27; 36/28; 36/35 B

[58] Field of Search ..... 36/28, 27, 29, 7.8, 36/35 R, 35 B, 37, 38

[56] References Cited

U.S. PATENT DOCUMENTS 4,262,433 4/1981 Hagg et al. ..... 36/35 B
4,378,642 4/1983 Light et al. ..... 36/28
4,573,279 3/1986 Feirer-Zogel et al. ..... 36/35 R
4,843,737 7/1989 Vorderer ..... 36/38
4,942,677 7/1990 Flemming et al. ..... 36/27
4,972,611 11/1990 Swartz et al. ..... 36/28
5,005,300 4/1991 Diaz et al. ..... 36/28
5,060,401 10/1991 Whatley ..... 36/27

*Primary Examiner*—Steven N. Meyers

[57] ABSTRACT

A midsole for footwear comprises an U-shaped shock absorbing device including a transparent housing, a plurality of tubes, letters or designs supported on a basic body, and a connecting member. The connecting member fixes the basic body to the transparent housing. The shock absorbing device will not twist and move during walking, will provide an excellent cushioning function and will have a fashion effect.

17 Claims, 2 Drawing Sheets

SHOCK ABSORBING DEVICE FOR USE IN A MIDSOLE OF A FOOTWEAR

BACKGROUND OF THE INVENTION

1. Field of the Invention

The present invention relates to a shock absorbing device for use in a midsole of a footwear such as shoes, sport shoes, military shoes, mountain-climbing shoes, etc., and more particularly, an U-shaped shock absorbing device fixed to an U-shaped groove disposed on the back side of a heel portion of a midsole of a footwear, an U-shaped shock absorbing member slidably fixed to the U-shaped transparent housing whereby the interior of the shoe can continuously absorbed the shocks to the backside of the foot during walking so that the device provides a cushion function and further a fashion effect.

2. Description of the Prior Art

Various types of insoles for shoes, which have a ventilating and shock absorbing system are well known in the art. Such prior art insoles are shown in the following publications U.S. Patent No. 4,499,672 discloses a midsole providing ventilation and shock absorption. The midsole is joined to the outsole by means of projections.

Korean Utility Patent No. 90-2,356 discloses a footwear sole providing ventilation and shock absorption and having a ventilation cap having a fixable connection joint cap. The heel side part of the complementary sole has a cork layer on its surface formed as a circular curve part and projections for a cushion are prepared on the reverse side thereof while on the front, a round projected part is formed as well as cushioning projections with ventilation punched holes. The front part of the midsole has a space part with a round projected part prepared at the inner side of the outskirts.

Korean Utility Patent Publication No. 90-2,537 discloses a footwear sole providing ventilation and shock absorption which has an airing cap fitted to its receptacle. The front part of a soft cushion midsole has punched holes while the reverse side of it has shock absorbing projections. The back part of the reverse side of the cushioned midsole has circular projections while the back part of the outsole has an air inhalation and exhalation opening. The projected part on the front of the heel was prepared for fitting to the airing cap which has ventilation holes and receptacles.

Korean Utility Patent Publication No. 90-2,538 discloses a footwear sole providing ventilation and shock absorption and which has a heel cushioned pad on the surface of the outsole. A soft cushioned pad with a surface of a cork layer is fitted to the inside of the cut part which was prepared at the front part of a hard Texon board midsole. The surface of the cushioned pad was attached to the texon board midsole by a textile net. The reverse side of the cushioned pad has cushioned projections through which ventilation holes extend. The reverse side of the heel cushioned pad has a curve part on its surface containing an air ventilation chamber and an air supply passage. The inner part of the air inhalation chamber has shock absorbing projections.

The above-described technology allows good ventilation within footwear as the airing cap has ventilation holes but cannot effectively prevent water from getting into the footwear in bad weather.

However, the shock absorbing material at the heel is not fitted in the inside of the heel of the sole, and the effective shock absorption at the heel of the shoe cannot be expected. Further, the fact that the cushioned shock absorbing material for the heel is not fitted at a Texon board prevents good shock absorbing effect to the backside of the foot and will not remove the negative factors for the shock absorption when the sole of footwear has a heel, such as shoes, military shoes and mountain climbing shoes, due to the twisted hard iron fitted at the Texon board.

In order to avoid such problems, one approach is a footwear sole having a waterproof and ventilation part secured in the midsole or the outsole, and a horseshoe-shaped shock absorbing heel member secured in the heel portion of the sole part in which the waterproof and ventilation part is secured. The waterproof and ventilation part includes a buoyancy plate that blocks penetration of water into the sole during bad weather. The shock absorbing heel member has opposite flanges with an empty space therebetween that insure very good shock absorbing properties of the shock absorbing heel member. However, the horseshoe-shaped shock absorbing heel member can be twisted or moved, and dust gathers thereon during walking.

SUMMARY OF THE INVENTION

Accordingly, it is an object of the present invention to provide a shock absorbing device for use in a midsole of a footwear, which eliminates the above problems encountered with inner soles of a footwear.

Another object of the present invention is to provide an improved midsole having an U-shaped shock absorbing member which includes a transparent housing having an elongated projection and an elongated basic body having a plurality of tubes or a plurality of letters or designs supported on one side and an elongated channel disposed on the other side of the basic body for slidably, tightly receiving the elongated projection of the housing whereby the shock absorbing member provides a cushion function and further fashion effect.

A further object of the present invention is to provide a midsole of a shoe, which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a midsole of a footwear, which comprises an U-shaped shock absorbing device including a transparent housing, a plurality of tubes, letters or designs supported on a basic body, and a connecting member for fixing to each other whereby the shock absorbing device can be prevented from twisting and moving during walking and whereby excellent cushion function and a fashion effect are provided.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
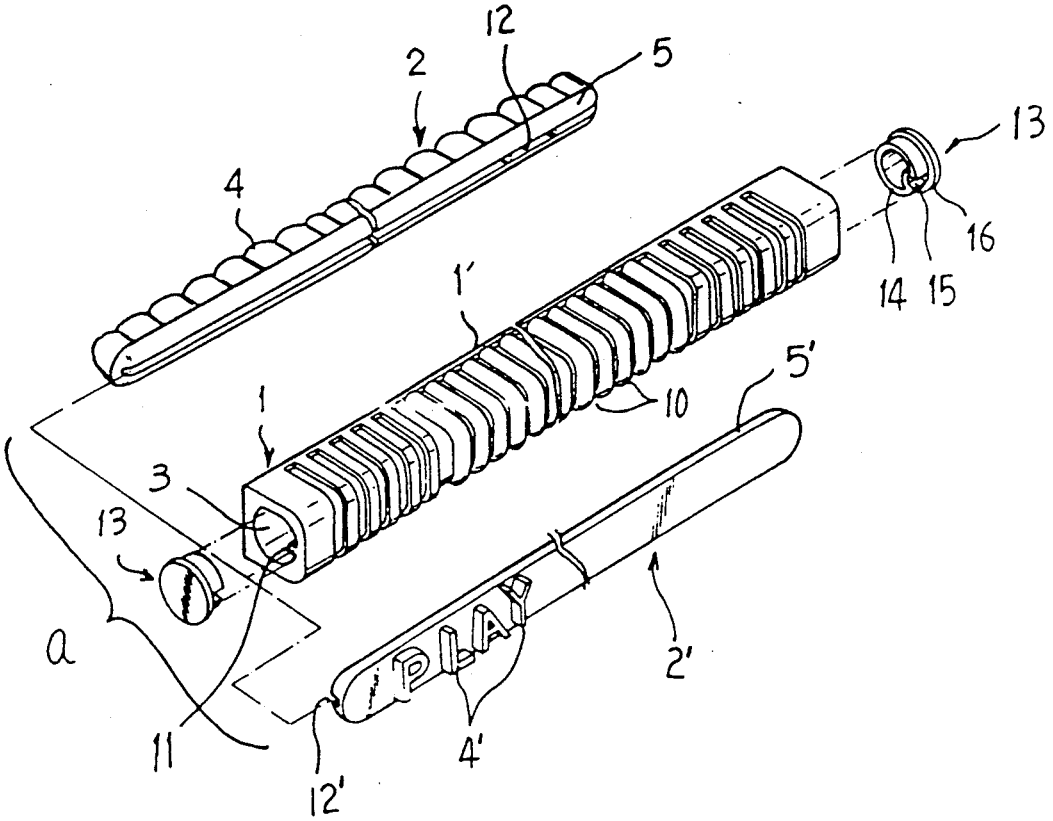
FIG. 1 is an exploded perspective view of the U-shaped shock absorbing member according to the present invention.
Figure 2:
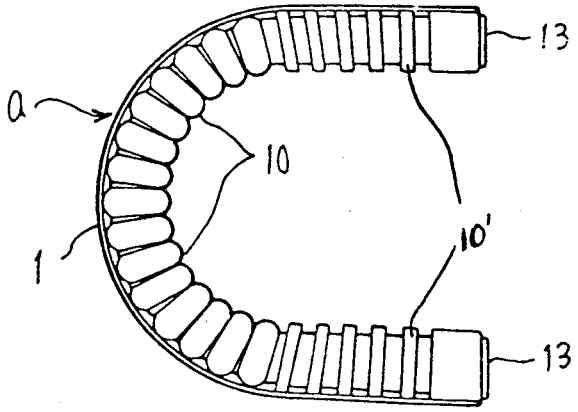
FIG. 2 is a perspective view of the U-shaped shock absorbing member according to the present invention.
Figure 3:
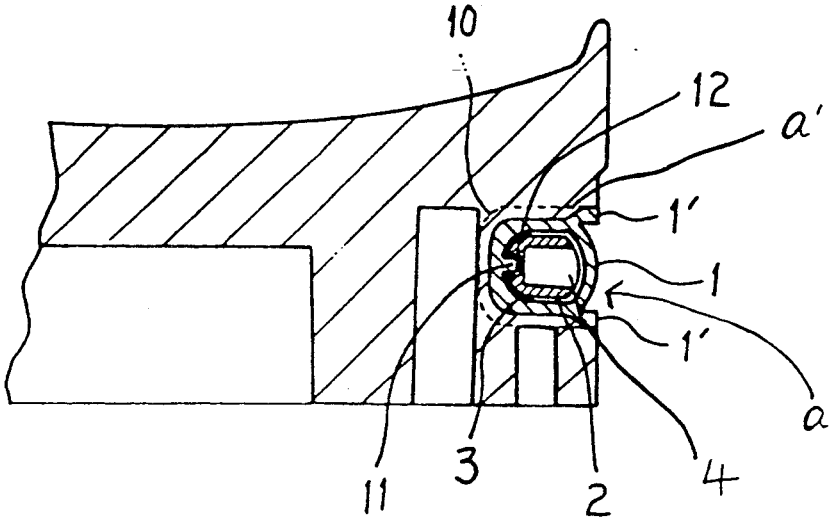
FIG. 3 is a sectional view of the U-shaped shock absorbing member fixed to the midsole of a footwear according to the present invention.

Referring now in detail to the drawings for the purpose of illustrating preferred embodiments of the present invention, the shock absorbing device (a) for use in a heel portion of a midsole of a footwear as shown FIGS. 1, 2, and 3, comprises a transparent, tubular housing 1 having a hollow portion 3, a shock absorbing member 2 or 2' disposed within the hollow portion 3 of the transparent, tubular housing 1, and a pair of caps 13 fitted to both ends of the tubular housing.

The transparent, tubular housing 1 has an U-shaped configuration and includes an elongated projection 11 disposed on the interior thereof. The housing made of transparent plastic and the like has a pair of flanges 1', a plurality of center raised portions 10 and a plurality of side raised portions 10. The center raised portion 10 are larger than the side raised portions 10' for easily forming an U-shaped when the housing 1 containing the shock absorbing member 2 or 2' is fixed to the backside of the heel portion of the midsole.

One of two shock absorbing member 2 or 2' can be used. Both members 2, 2' include a basic body 5 or 5', respectively, made of elastic material such as rubber or plastic. The basic body 5 has a plurality of tubes 4, while the basic body 5' has a plurality of letters or designs 4' supported on one side and an elongated channel 12 or 12', respectively, disposed on the other side thereof for slidably, tightly receiving the elongated projection 11.

Each of the pair of caps 13 includes a circular flange 16, a tubular extension 14, a slit 15 disposed in the tubular extension 14, for tightly receiving one end portion of the projection 11 Accordingly, the U-shaped shock absorbing device (a) can effectively absorb the shocks to the backside of the foot during walking and can prevent the shock absorbing member 2, 2' from twisting and moving in the hollow portion 3 of the transparent, tubular housing 1. Furthermore, the U-shaped shock absorbing device (a) can easily fit to a U-shaped groove (a') disposed along the middle portion of a circumferential backside of the heel portion of the midsole of a footwear since the plurality of center raised portions 10 are larger than the plurality of side raised portions 10'.

Accordingly to the present invention, the shock absorbing device (a) for use in the midsole of a footwear is assembled and operates as follows.

In FIG. 1, the shock absorbing member 2 having the plurality of tubes 4 supported on the basic body 5 is first inserted into the hollow portion 3 of the tubular housing 1 and simultaneously the elongated channel 12 of the basic body 5 goes along the elongated projection 11 of the interior of the housing after the projection 11 is tightly inserted into the channel 12. Thereafter, when the pair of caps 13 are fitted with both ends of the tubular housing 1, both end portions of the projection 11 of the tubular housing 1 is tightly inserted into the slits 15 of the tubular extensions 14 of the caps 13 and both circular flanges 16 of the caps 13 are tightly fitted with both ends of tubular housing 1. Alternatively, the shock absorbing member 2' with the plurality of letters 4' supported on the basic body 5' can be substituted for the shock absorbing member 2 with the plurality of tubes 4 supported on the basic body 5.

Figure 4:
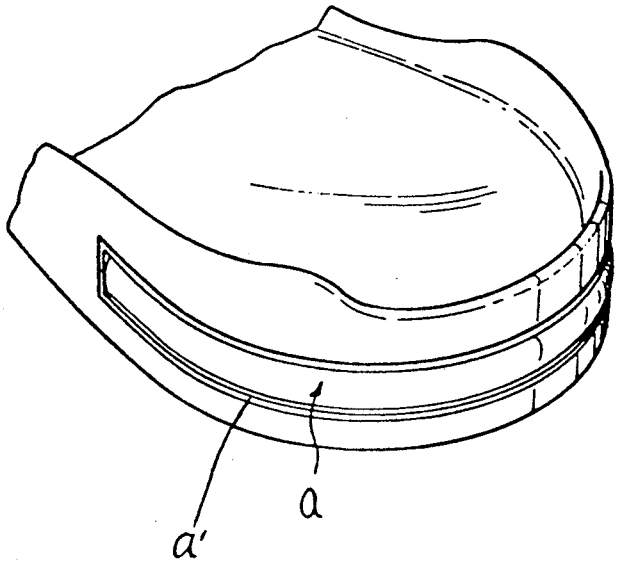
FIG. 4 is a perspective view of an U-shaped groove disposed on the circumference of the backside of a heel portion of the midsole of a footwear according to the present invention.

The assembled shock absorbing device (a) can be easily formed as an U-shaped configuration (FIG. 2) for slidably, tightly fixing to the U-shaped groove (a') disposed on the backside of the heel portion (FIG. 4). This is because the plurality of center raised portions 10 are larger than both plurality of side raised portions 10'. After then, the U-shaped shock absorbing device (a) is inserted into and fixed into the U-shaped groove (a') as shown in FIGS. 3 and 4.

Accordingly, the shock absorbing device (a) fixed to the heel portion provides an excellent cushion function since the plurality of tubes 4 or letters 4' and the tubular housing, even though it contains the shock absorbing member 2, can cushion, and a beautiful fashion effect since the tubular housing 1 is transparent, the regular tubes 4, or the letters or designs 4' are visible so that the advertising effect can be seen therethrough.

While one who wears shoes containing a midsole with the shock absorbing device (a) of the present invention and are walking, the shocks to the backside of heel portions of the shoes can be effectively absorbed by the shock absorbing device (a) and then the shock absorbing member 2 does not move and does not twist due to a locking system which defines the projection 11 and the channel 12 and the slits 11. Thus, the shock absorbing device (a) provides an excellent cushion function.

Furthermore, since the tubular housing 1 is transparent, the letters or designs 4' or tubes 4 are visible so that the shock absorbing device (a) provides a beautiful fashion function, which can be used as an advertising media.

Also, the shock absorbing device (a) is tightly fitted with the U-shaped groove (a') of the heel portion of the midsole by means of an adhesive. At this time, the pair of flanges 1' can accelerate the cushion function (FIG. 3). The plurality of center raised portions 10 and a plurality of side raised portions 10' which are smaller than the center raised portions can contribute to form an U-shaped configuration of the shock absorbing device 1.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A shock absorbing device for use in a midsole of a footwear, comprising:

a transparent, tubular elongated housing having a generally rectangular configuration, said housing including:

an elongated projection disposed on the interior thereof, a plurality of center raised portions and a plurality of side raised portions disposed on three faces of the outside thereof, and a pair of flanges disposed on remaining one face of the outside thereof, a shock absorbing member disposed within said transparent, tubular elongated housing, said shock absorbing member including;

a basic body having two sides, means for displaying and cushioning supported on one of said sides, the means for displaying and cushioning being visible through the housing whom the shock absorbing member is disposed within the housing to thereby perform a fashion function, and an elongated channel disposed on the other of said sides for slidably, tightly receiving said projection of the housing, the elongated channel when receiving the projection preventing the shock absorbing member from moving and twisting within the tubular housing, whereby the shock absorbing device acts as a cushion.

2. The shock absorbing device of claim 1, wherein said means for displaying and cushioning comprises a plurality of tubes supported on the basic body.

3. The shock absorbing device of claim 1, wherein said means for displaying and cushioning comprises one of a plurality of letters, designs, and a combination of letters and designs supported on the basic body.

4. The shock absorbing device of claim 1, wherein the basic body is made of rubber.

5. The shock absorbing device of claim 1, wherein the housing is made of transparent plastic.

6. The shock absorbing device of claim 1, further comprising a first cap and a second cap, the housing having a first and second end, the first cap being fittable into the first end of the housing and the second cap being fittable into the second end of the housing.

7. The shock absorbing device of claim 6, wherein each cap further comprises a flange having a tubular extension on one side thereof, each of the tubular extensions having a slit which mates with the elongated projection when the cap is in the end of the housing.

8. The shock absorbing device of claim 1, wherein the housing has a U-shape.

9. The shock absorbing device of claim 1, wherein the center raised portions of the housing are larger than the side raised portions.

10. The shock absorbing device of claim 9, wherein the housing has a U-shape and wherein the means for displaying and cushioning faces the remaining one face of the housing when the shock absorbing member is disposed within the housing.

11. The shock absorbing device of claim 10, wherein one of the flanges of the pair of flanges is positioned on an upper side of the housing and the other flange is positioned on a lower side of the housing, the means for displaying and cushioning being visible through the housing between the pair of flanges.

12. The shock absorbing device of claim 11, wherein said means for displaying and cushioning comprises a plurality of tubes supported on the basic body.

13. The shock absorbing device of claim 11, wherein said means for displaying and cushioning comprises one of a plurality of letters, designs, and a combination of letters and designs supported on the basic body.

14. The shock absorbing device of claim 1, wherein one of the flanges of the pair of flanges is positioned on an upper side of the housing and the other flange is positioned on a lower side of the housing, the means for displaying and cushioning being visible through the housing between the pair of flanges.

15. The shock absorbing device of claim 14, wherein said means for displaying and cushioning comprises a plurality of tubes supported on the basic body.

16. The shock absorbing device of claim 14, wherein said means for displaying and cushioning comprises one of a plurality of letters, designs, and a combination of letters and designs supported on the basic body.

17. The shock absorbing device of claim 1, wherein the channel on the other of said sides of the shock absorbing member extends along a length of the shock absorbing member, the other side of the shock absorbing member having the channel facing away from the remaining one face of the housing having the flanges when the shock absorbing member is disposed within the housing.

* * * * *